US005208404A

United States Patent [19]

Lu

[11] Patent Number: 5,208,404

[45] Date of Patent: May 4, 1993

[54] PROCESS FOR PRODUCING FUEL OIL AND GAS BY CRACKING WASTE RUBBER

[75] Inventor: Chaur G. Lu, Taitung, Taiwan

[73] Assignee: Full Born Chen Industrial Co., Ltd., Taitung, Taiwan

[21] Appl. No.: 822,669

[22] Filed: Jan. 21, 1992

[51] Int. Cl.[5] ..... C07C 1/00

[52] U.S. Cl. ..... 585/241; 585/240

[58] Field of Search ..... 585/240, 241

[56] References Cited

U.S. PATENT DOCUMENTS 4,251,500 2/1981 Morita et al. ..... 585/241

4,515,659 5/1985 Wingfield, Jr. et al. ..... 585/241

*Primary Examiner*—Asok Pal

*Attorney, Agent, or Firm*—Bell, Seltzer, Park & Gibson

[57] ABSTRACT

A process for producing fuel oil and gas by cracking waste rubber, comprising the reaction of about 2–6 parts catalyst with about 40 parts waste rubber, wherein the catalyst consists of 15%–25% by wt. of CaO, 40%–60% by wt. of Ni, 20%–40% by wt. of XT-10, and traces of Nb and Ti. The reactant is heated to about 280° C. while the pressure of the reactor is increased to about 2 kg/cm$^2$. The gas products are filtered, condensed, and fractioned into light oil, heavy oil and gas for respective storage. The total reaction time is about 2 hours.

5 Claims, No Drawings

PROCESS FOR PRODUCING FUEL OIL AND GAS BY CRACKING WASTE RUBBER

BACKGROUND OF THE INVENTION

The present invention relates to a process for producing fuel oil and gas by cracking waste rubber, comprising the use of a suitable catalyst, under specific temperature and pressure conditions, to crack the waste rubber so as to produce fuel oil and gas, and in the process, recycle the waste rubber.

In industry, rubber products are widely used owing to their unique properties. Furthermore, the rubber industry is well developed worldwide, and non-biodegradable waste rubber is accumulating and has become a pollution problem. Although there are many existing processes for treating waste rubber, the most common process is to crack waste rubber with a suitable catalyst under selected conditions, because it can produce useful fuel oil and gases while avoiding the secondary pollution problem. However, this cracking process usually involves long cracking time and high capital cost; therefore, it is impractical by utilizing these conventional cracking processes to treat the waste rubber.

Compared with several other production processes, the present invention provides a process for producing fuel oil and gas by cracking waste rubber in a shorter reaction time than that of any previously known process, and, furthermore, overcomes the commercialization problem by having a lower capital cost.

Currently available rubber can be classified into two types.

I. Natural Rubber

A. Natural rubber is made from the latex of rubber plants; it is firstly concentrated into a crude rubber of about 94% rubber by weight.

B. This crude rubber is a hydrocarbon of the formula:

2-methyl-1,3-butadiene or isoprene

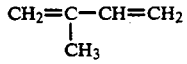

C. It is then refined into secondary crude rubber, and which is softened between 130° C. and 140° C., melted at 200° C., and drastically decomposed at 270° C.

II. Synthetic Rubber

A. Synthetic rubber is produced by the catalysis and polymerization of petroleum oil.

B. It is classified into diene, olefine, sulfide compound, organic dilicon compound, fluorine compound, ester, and vinyl compound. Diene (BR, SBR, and NBR rubber) and olefine (II R, EPM, and EPDM rubber) have been found to have more economical properties than the others, with rapid reaction rates. The majority of diene are 1,3-butadiene and isoprene. The majority of olefine are isobutylene, ethylene and propylene.

The materials currently used for tires and wire insulators are mainly either natural rubber or synthetic rubber (in the latter case preferably either diene or olefines). The constituents are variably proportioned for specific use. Additives, such as antiager, preservatives, fillers, coloring agents, etc., may also be incorporated into rubber products.

Rubber manufacturing is primarily a process of polymerization and copolymerization.

I. Polymerization

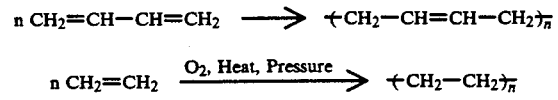

II. Copolymerization

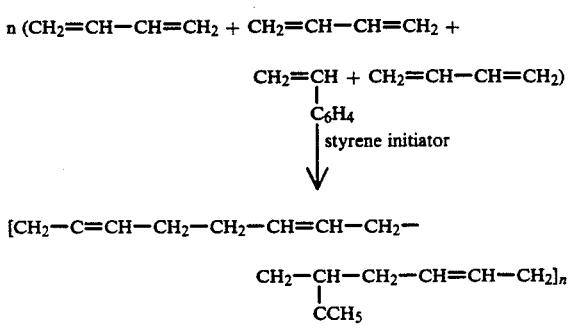

These compounds are polymerized and copolymerized as a result of the $\pi$ bond's affinity for electron, forming —C— carbonium, thereby reacting with free radicals more rapidly.

SUMMARY OF THE INVENTION

Accordingly, it is an object of this invention to provide a novel process for treating waste rubber.

A further object of this invention is to provide a novel process for producing fuel oil and gas by cracking waste rubber with a suitable catalyst under specific temperature and pressure conditions.

Another object of this invention is to provide a novel process for producing fuel oil and gas by cracking rubber, comprising the reaction of selected catalysts with waste rubber, wherein the catalysts are composed of CaO, Ni, XT-10, and traces of Nb and Ti. The waste rubber and catalysts are heated gently, softened at about 230° C., and stirred for about 1 hour at about 280° C. The pressure of the reactor is increased to 2 kg/cm$^2$ The formed products are then filtered, condensed, and fractioned into light oil, heavy oil, and gas for respective storage.

Further objectives and advantages of the present application will become apparent as the following description proceeds, and the features of novelty which characterize the invention will be pointed out with particularity in the claims annexed to and forming a part of this invention.

DETAILED DESCRIPTION OF THE PREFERRED EMBODIMENT

The present invention relates to a process for producing fuel oil and gas by cracking waste rubber, comprising the reaction of about 3 parts catalyst with about 40 parts waste rubber in a reactor. The catalyst is composed of 15%-25% by wt. of CaO, 40%-60% by wt. of Ni, 20%-40% by wt. of XT-10, and traces of Nb and Ti, and XT-10 is a mixture of one or more of the following groups: polomite, garbbro, microcline, Muscovite, tourmaline, talc, graphite-silkymicaschist, syenite, lenslimestone, sacharoidal-limestone, magnetite, shihui, shihuishi, and citu. Preferably, the catalyst is composed of 20% by wt. of CaO, 50% by wt. of Ni, 30% by wt. of XT-10, and traces of Nb and Ti.

First, the catalyst and waste rubber are heated gently, softened at about 230° C., and stirred for about 1 hour at about 280° C.; the pressure of the reactor is then increased to about 2 kg/cm$^2$. Gas products thus formed are then filtered, condensed, and fractioned into light oil, heavy oil, and gas for respective storage. The total reaction time is about 2 hours.

For convenience, the composition of the catalyst used herein is tabulated as follow:

For convenience, the composition of the catalyst used herein is tabulated as follow:

| Composition | % wt | Use |
|---|---|---|
| CaO | 15–25 | Active Agent |
| Ni | 40–60 | Auxiliary Catalyst |
| Nb | — | — |
| Ti | — | — |
| XT-10 | 20–40 | Main Catalyst |

The main and auxiliary catalysts, being cross-catalytic, increase the formation of free radicals, and thus reduce the energy of activation (Eac) and speed the reaction. Furthermore, under the condition of the required reaction temperature and by means of the catalyst, the carbon bonds are broken in the proper positions for re-arrangement to complete the cracking of the rubber.

The following example illustrates the invention.

EXAMPLE 400 kg of waste rubber added with 30 kg of the above-mentioned catalyst is placed in a reactor and gently heated to 230° C. At this time, the blend begins to soften and melt. Then the mixture is stirred for 1 hour at 280° C. When the temperature is elevated to 320° C., $CO_2$ is released first, followed by fuel gas. At the same time, the pressure of the reactor is increased to 2 kg/cm$^2$, and the gas products, filtered and condensed, then flow into a storage tank, later to be fractioned into light oil, heavy oil, and gas. The total reaction time is 2 hours.

RESULT

Reactant & Product Table

| Reactants | | Products | | |
|---|---|---|---|---|
| Waste Rubber | 400 kg | (1) gas | 51.6 kg | 12% |
| Catalyst | 30 kg | (2) light oil | 73.1 kg | 17% |
| | | (3) heavy oil | 86 kg | 20% |
| | | (4) carbide slag | 172 kg | 40% |
| | | (5) metal wire | 34 kg | 8% |
| | | (6) slag | 12.9 kg | 3% |
| Total | 430 kg | | 430 kg | 100% |

The cracking procedure of the present invention uses the specific catalyst to complete the cracking of rubber within a period of 2 hours.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

I claim:

1. A process for producing fuel oil and gas by cracking rubber, comprising the reaction of about 2–6 parts catalyst with about 40 parts waste rubber in a reactor, wherein said catalyst is composed of CaO, Ni, XT-10, and traces of Nb and Ti, said XT-10 is a mixture of one or more of the following groups: polomite, garbbro, microcline, Muscovite, tourmaline, talc, graphite-silkymicaschist, syenite, lenslimestone, sacharoidal-limestone, magnetite, shihui, shihuishi, and citu; said catalyst and waste rubber being heated gently, softened at about 230° C., and stirred for about 1 hour at about 280° C., the pressure of the reactor being increased to about 2 kg/cm$^2$; gas products thus formed being then collected.

2. A process as claimed in claim 1, wherein said gas products are further filtered, condensed, and fractioned into light oil, heavy oil, and gas for respective storage.

3. A process as claimed in claim 1, wherein the total reaction time is about 2 hours.

4. A process as claimed in claim 1, wherein said catalyst is composed of 15%–25% by wt. of CaO, 50%–60% by wt. of Ni, 20%–40% by wt. of XT-10, and traces of Nb and Ti.

5. A process as claimed in claim 4, wherein said catalyst is composed of 20% by wt. of CaO, 50% by wt. of Ni, 30% by wt. of XT-10, and traces of Nb and Ti.

* * * * *

UNITED STATES PATENT AND TRADEMARK OFFICE

CERTIFICATE OF CORRECTION

PATENT NO. : 5,208,404

DATED : May 4, 1993

INVENTOR(S) : Chaur G. Lu

It is certified that error appears in the above-identified patent and that said Letters Patent is hereby corrected as shown below:

Column 2, line 19, "$C_6H_4$" should be -- $C_6H_5$ --.

Column 2, line 48, after "2kg/cm$^2$" insert -- . --.

Column 3, lines 18-19, delete "For convenience, the composition of the catalyst used herein is tabulated as follow:".

Column 4, line 4 "Reactant & Product Table" should be above table.

Column 4, line 46, "50%-60%" should be -- 40%-60% --.

Signed and Sealed this

First Day of February, 1994

Bruce Lehman

*Attest:*

BRUCE LEHMAN

*Attesting Officer*

*Commissioner of Patents and Trademarks*